US007417555B2

(12) United States Patent
Chivarov et al.

(10) Patent No.: US 7,417,555 B2
(45) Date of Patent: Aug. 26, 2008

(54) DEVICE FOR VISUALIZATION OF INFORMATION ON A ROTATING VISIBLE SURFACE

(76) Inventors: Stefan N. Chivarov, 47 Bigla Str. en.A., Sofia 1126 (BG); Joseph E. Shurance, 613 W. Walley Parkway #230, Escondido, CA (US) 92025

( * ) Notice: Subject to any disclaimer, the term of this patent is extended or adjusted under 35 U.S.C. 154(b) by 65 days.

(21) Appl. No.: 10/527,508

(22) PCT Filed: Nov. 29, 2002

(86) PCT No.: PCT/BG02/00030

§ 371 (c)(1),
(2), (4) Date: Mar. 10, 2005

(87) PCT Pub. No.: WO2004/025610

PCT Pub. Date: Mar. 25, 2004

(65) Prior Publication Data

US 2006/0007011 A1 Jan. 12, 2006

(30) Foreign Application Priority Data

Sep. 11, 2002 (BG) ..... 107082

(51) Int. Cl.
*G08B 5/22* (2006.01)

(52) U.S. Cl. ..... 340/815.45; 340/432; 362/276

(58) Field of Classification Search ..... 340/815.45, 340/432, 444, 463, 815.53; 362/276, 500
See application file for complete search history.

(56) References Cited

U.S. PATENT DOCUMENTS 4,689,604 A 8/1987 Sokol
5,584,562 A * 12/1996 Geran ..... 362/473
5,748,157 A 5/1998 Eason
5,800,039 A 9/1998 Lee (Continued)

FOREIGN PATENT DOCUMENTS

DE 19737621 3/1999

(Continued)

OTHER PUBLICATIONS

Search Report for PCT/BG2002/000030, Apr. 29, 2003.

(Continued)

*Primary Examiner*—Phung T. Nguyen
(74) *Attorney, Agent, or Firm*—Marhall, Gerstein & Borun LLP

(57) ABSTRACT

A device which can be used on rotating visible surfaces of, for example, machines, appurtenances, vehicles, and fans, utilizes N light sources, evenly disposed on a flexible substrate, and connected by means of a driver to a microcontroller with an independent power supply. A synchronization sensor is connected to the microcontroller. The light sources may be LEDs—one- or three-colored (RGB). The synchronization sensor responds to gravity when mounted on a rotating surface, whose rotation axis is not perpendicular to the Earth's surface, or is actuated at a position relative to a given immovable point, provided the rotation axis is perpendicular to the Earth's surface. A light sensor is connected to the microcontroller, which in turn is connected to a control panel. Sensors and the control panel are disposed on the substrate. The microcontroller has a serial interface.

20 Claims, 4 Drawing Sheets

U.S. PATENT DOCUMENTS

| | | | | |
|---|---|---|---|---|
| 5,839,814 | A * | 11/1998 | Roberts | 362/545 |
| 6,013,101 | A * | 1/2000 | Israel | 623/6.43 |
| 6,037,876 | A | 3/2000 | Crouch | |
| 6,072,386 | A * | 6/2000 | Yu | 340/432 |
| 6,175,196 | B1 * | 1/2001 | Ragner et al. | 315/200 A |
| 6,485,169 | B1 * | 11/2002 | Ragner | 362/500 |
| 6,492,963 | B1 * | 12/2002 | Hoch | 345/39 |
| 6,683,292 | B1 * | 1/2004 | Charng | 250/205 |
| 6,789,928 | B2 * | 9/2004 | Khan | 362/500 |
| 7,046,131 | B2 * | 5/2006 | Todorox | 340/444 |

FOREIGN PATENT DOCUMENTS

| | | |
|---|---|---|
| GB | 2 311 401 | 9/1997 |
| GB | 2 326 513 | 12/1998 |
| WO | WO 02/23515 | 3/2002 |

OTHER PUBLICATIONS

Comments submitted to International Bureau accompanying amendments in PCT/BG2002/000030, Oct. 3, 2005.

* cited by examiner

DEVICE FOR VISUALIZATION OF INFORMATION ON A ROTATING VISIBLE SURFACE

REFERENCE TO RELATED APPLICATIONS

This application is the United States National Stage, under 35 U.S.C. §371, of International Application No. PCT/BG2002/000030, having an international filing date of Nov. 29, 2002. This application further claims priority to Bulgaria patent application No. 107082, filed Sep. 11, 2002.

FIELD OF THE INVENTION

The present invention relates to a device for visualization of information on a rotating visible surface, used on rotating visible surfaces of machines, devices, transportation vehicles, fans, and others.

BACKGROUND OF THE INVENTION

A known device for visualization of information comprises N light sources—monochromatic light emitting diodes (LEDs), evenly disposed in an array on a hard even substrate, whose inputs are connected to a control circuitry powered by an independent power supply and fastened to the substrate. The substrate itself is radially disposed between two neighboring spokes of a bicycle wheel. The control circuitry consists of a centrifugally controlled switch, whose output is connected to the input of a time delay controller, whose first output is connected to the input of a visual pattern selector, and its second output—to a controller setting up the delay time. The outputs of the visual pattern selector and the time delay controller are connected to the inputs of a controllable power supply, whose output is connected to a lighting controller. When the bicycle wheel is rotated, the centrifugally controlled switch is triggered on, and switches on the visual pattern selector. The resulted pattern is pre-selected from the collection of patterns stored in the selector. The controller setting up the delay time assigns a different flashing-on time to each separate diode. The flashing on of the light emitting diodes at different times produces a quasimetric field that displays a two-dimensional monochromatic image, enhanced by the transitional vision [U.S. Pat. No. 5,800,039].

A disadvantage of this device is that the resulted image is continually drifting, because it is not synchronized with the rotation speed of the wheel. Moreover, it has lower informational capabilities due to the fact that it generates only two-dimensional monochromatic images. Further disadvantage is that the device is working as long as the wheel is rotating, regardless of the intensity of the surrounding light. This results in reduced image perception capabilities, especially in daylight or in bright sidelight. This redundant mode of operation leads to a faster exhaustion of the independent power supply, which, therefore, needs frequent replacement. Another disadvantage of the device is its limited scope, because it is only applicable to bicycles, and functions only if mounted on specific places between bicycle spokes.

Another device for visualization of information which is known from the prior art is designed especially for transportation vehicles. It consists of one to M groups of light sources, each containing N light emitting diodes, evenly disposed in an array. Each group of LEDs is mounted on a separate hard, even substrate. All diodes on a substrate have the same color. They are connected to the respective control circuitry with an independent power supply. The substrates are radially disposed at even angular distances from each other on a rotating object, like a bicycle wheel, for example. The control circuitries of the separate groups are connected to a serial output bus of a central microcontroller. It consists of a microcontroller with an independent power supply, control panel, and memory. The central microcontroller may be installed on one of the substrates and thus have a common power supply with the group of the light emitting diodes on the substrate. A magnet is fastened on a stationary part of the machine, like the front fork of a bicycle. A synchronization sensor is secured at a suitable position on a rotating part of the vehicle, like a wheel, and is triggered every time it passes the magnet. The output of this detector is connected to an informational input port of the microprocessor. The pattern of the image that will be visualized is pre-selected by the control panel. When the bicycle wheel is rotated, the microprocessor is activated by the detector and starts sending control signals to the respective groups of diodes. At the same time, the microprocessor sets the rotation speed of the wheel, and based on it determines the moment when the diodes will be flashed on, so as to form an image at the same place. Therefore, due to the transitional vision, the lighting on of the light emitting diodes at different times produces a quasimetric field that displays M groups of two-dimensional monochromatic images, each with a different color [PCT/US00/25098].

A disadvantage of this device is that it has reduced image perception capabilities, because it generates only two-dimensional monochromatic images. Another disadvantage of the device is that its mechanism is rather complex, because it comprises a plurality of independent components, interconnected by means of movable wires. This, coupled with the presence of a magnet and a detector, reduces its reliability.

Another disadvantage of this device is that its permanent mode of operation leads to energy loss. Yet another disadvantage is that the generation of a high-quality image requires a very precise positioning of the separate light emitting sources on a rotating part of a vehicle.

Another device for visualization of information for transportation vehicles is known. It consists of a number of light emitting diodes (LEDs) of one or different colors, disposed in arrays and controlled independently. The arrays of LEDs are radially disposed on at least one rotating around an axis visible carrier element of the construction of the transportation vehicle. The LEDs flash and fade depending on the current angular speed of the rotating element. When the rotation speed is low the arrays of LEDs are disposed on more than one rotating around an axis visible carrier elements of the construction of the transportation vehicle. The carrier element is provided with a sensor communicating with another sensor, positioned at the frame of the vehicle, which sends a signal defining the initial position and the subsequent synchronized flashing of the LEDs in order to produce a visual pattern. The controlling signals are produced by one or several processors. It is possible that the processor is situated on the carrier rotating element and receives signals from another processor, immovably fixed to the frame of the vehicle. The power supply of the elements on the carrier rotating element is carried out by means of a power supply unit provided at the same place. In order to avoid the loss of synchronization, there are radial doubling arrays around each array of LEDs onto a carrier rotating element. At the command of the processor the radial doubling arrays are controllably switched on instead of the main array (DE 197 37 621 C).

A disadvantage of this device is that it is complicated, consists of a number of independent components connected to each other via unreliable communication channels. This reduces the reliability of the device.

It is the objective of this invention to create a device for visualization of information on a rotating visible surface that provides a higher quality of the generated images, reliability, and enhanced informational capabilities.

TECHNICAL DESCRIPTION OF THE INVENTION

This objective is fulfilled by providing a device for visualization of information on a rotating visible surface, operable for displaying images, which comprises a plurality of light sources—light emitting diodes, evenly disposed on a substrate, and connected by means of a driver to a microcontroller with an independent power supply. The microcontroller is mounted on the substrate. A synchronization sensor is connected to the microcontroller. The LEDs are one- or three-colored (RGB), the substrate is flexible. The synchronization sensor 6 responds to gravity when mounted on a rotating surface, whose rotation axis is not perpendicular to the Earth's surface; if the rotation axis is perpendicular to the Earth's surface, the synchronization sensor is actuated at a position relative to a given immovable point. A light sensor is connected to the microcontroller, which is also connected to a control panel. The two sensors and the control panel are secured on the substrate. The microcontroller has a serial interface.

The substrate may accommodate additional P groups of LEDs, containing the same or different numbers of LEDs, which have the same or different colors, or are RGB. These groups of LEDs may be arranged in parallel, in an array, in a checkered pattern, or in any other preset pattern in the same plane or at various distances from the substrate.

It is also possible that the bottom of the substrate 2 is covered with a sticky foil.

It is possible that the substrate 2 is hard and with a preset profile.

The advantage of the device for visualization of information on a rotating visible surface is that it provides a higher quality of the generated images, reliability, and has enhanced informational capabilities.

DESCRIPTION OF THE DRAWINGS

A preferred embodiment of the invention, shown on the appended drawings, provides a detailed description of the device.

EXAMPLE OF CARRYING OUT THE INVENTION

Figure 1:
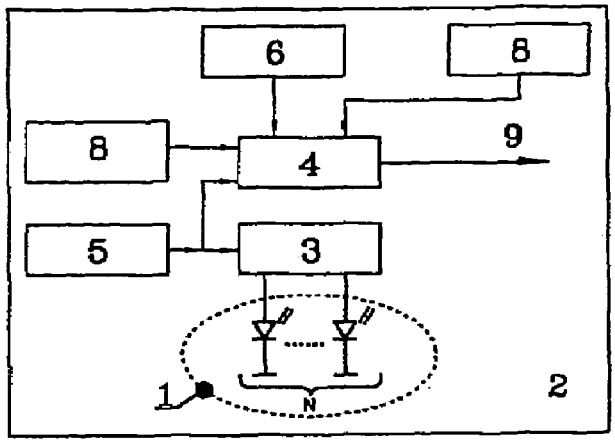
FIG. 1 is a block diagram of the device.
Figure 2:
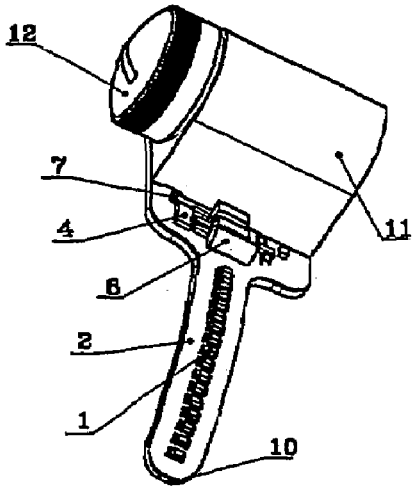
FIG. 2 is an axonometric view of the device with a single array of LEDs.
Figure 3:
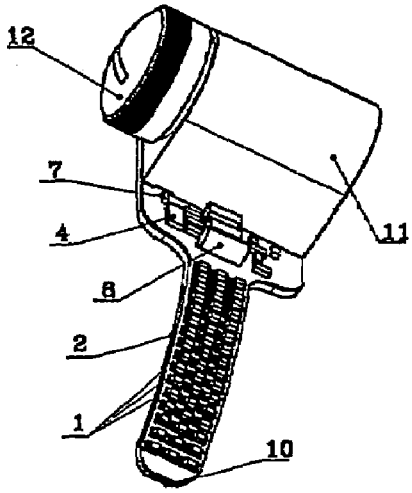
FIG. 3 is an axonometric view of the device with three parallel arrays of LEDs.
Figure 4:
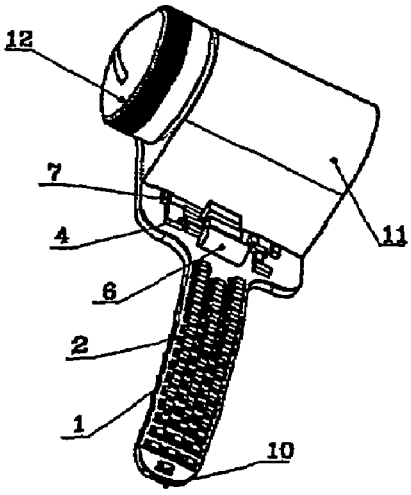
FIG. 4 is axonometric view of the device with three parallel arrays of LEDs, arranged in a checkered pattern.
Figure 5:
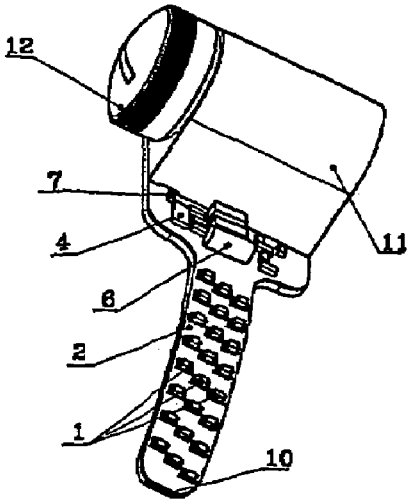
FIG. 5 is an axonometric view of the device with three parallel arrays of LEDs arranged diagonally.

The device for visualization of information on a rotating visible surface, operable for displaying images, comprises a plurality of light sources—N light emitting diodes 1, evenly disposed in an array on a substrate 2 and connected by means of a driver 3 to a microcontroller 4 with an independent power supply 5. The microcontroller 4 is mounted on the substrate 2. A synchronization sensor 6 is connected to the microcontroller 4. The LEDs 1 are one- or three-colored (RGB), the substrate 2 is flexible, and the synchronization sensor 6 responds to gravity when mounted on a rotating surface, whose rotation axis is not perpendicular to the Earth's surface; if the rotation axis is perpendicular to the Earth's surface, the synchronization sensor is actuated at a position relative to a given immovable point. A light sensor 7 is connected to the microcontroller 4, to which is connected the control panel 8. The two sensors 6 and 7 and the control panel are disposed on the substrate 2. The microcontroller 4 has a serial interface 9.

Figure 6:
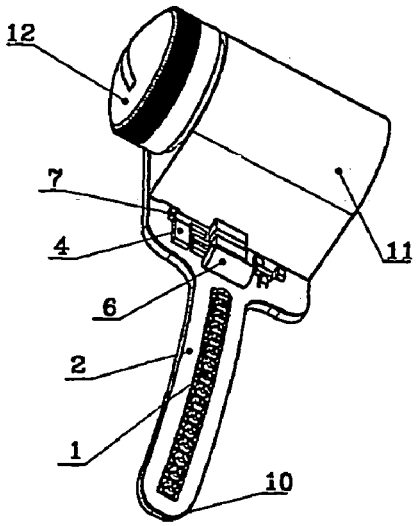
FIG. 6 is an axonometric view of the device with a single array of RGB LEDs.
Figure 7:
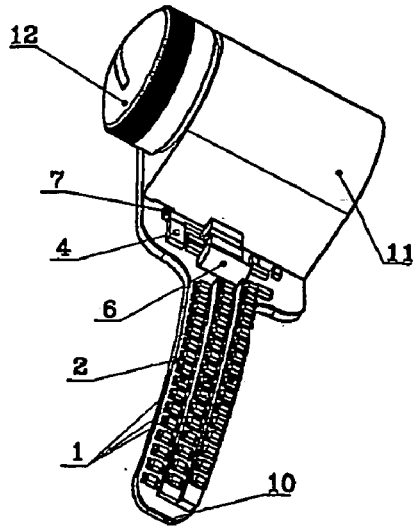
FIG. 7 is an axonometric view of the device with three parallel arrays of LEDs arranged diagonally, each one of which is placed at a different distance from the substrate.

It is possible ((FIGS. 2, 3, 4, 5, 7) that the substrate accommodates additional P parallel groups of LEDs, containing the same or different numbers of LEDs, which have the same or different colors, or are RGB (FIG. 6). These groups of LEDs may be arranged in an array, in a checkered pattern, or in any other preset pattern in the same plane or at various distances from the substrate 2.

It is also possible (FIG. 2 to FIG. 7) that the bottom of the substrate 2 is covered with a sticky foil 10.

Figure 8:
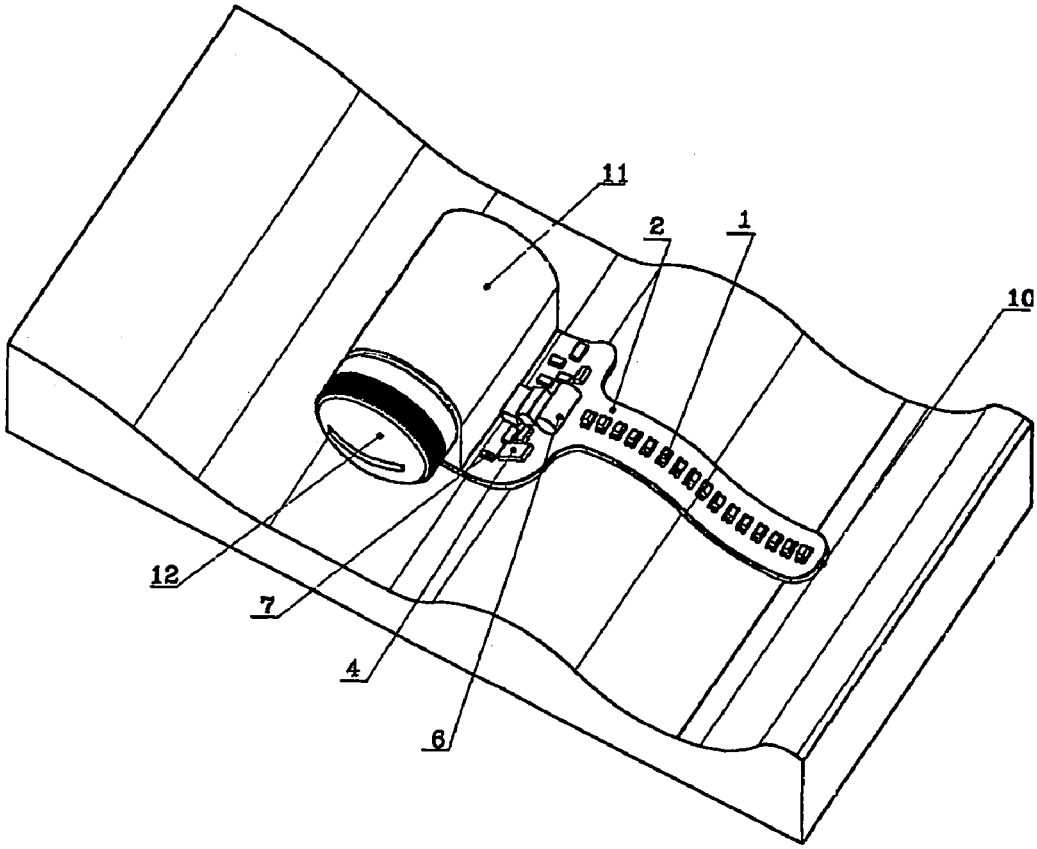
FIG. 8 is an axonometric view of the device with a hard substrate 2 that has a preset profile.

Also it is possible (FIG. 8) that the substrate 2 is hard and with a preset profile.

The battery of the power supply is housed in a housing case 11, hermetically sealed with a removable top cover 12. The housing case 11 is also mounted on the substrate.

The electronic elements of the device are disposed at a suitable position on the wide part of the substrate.

Figure 9:
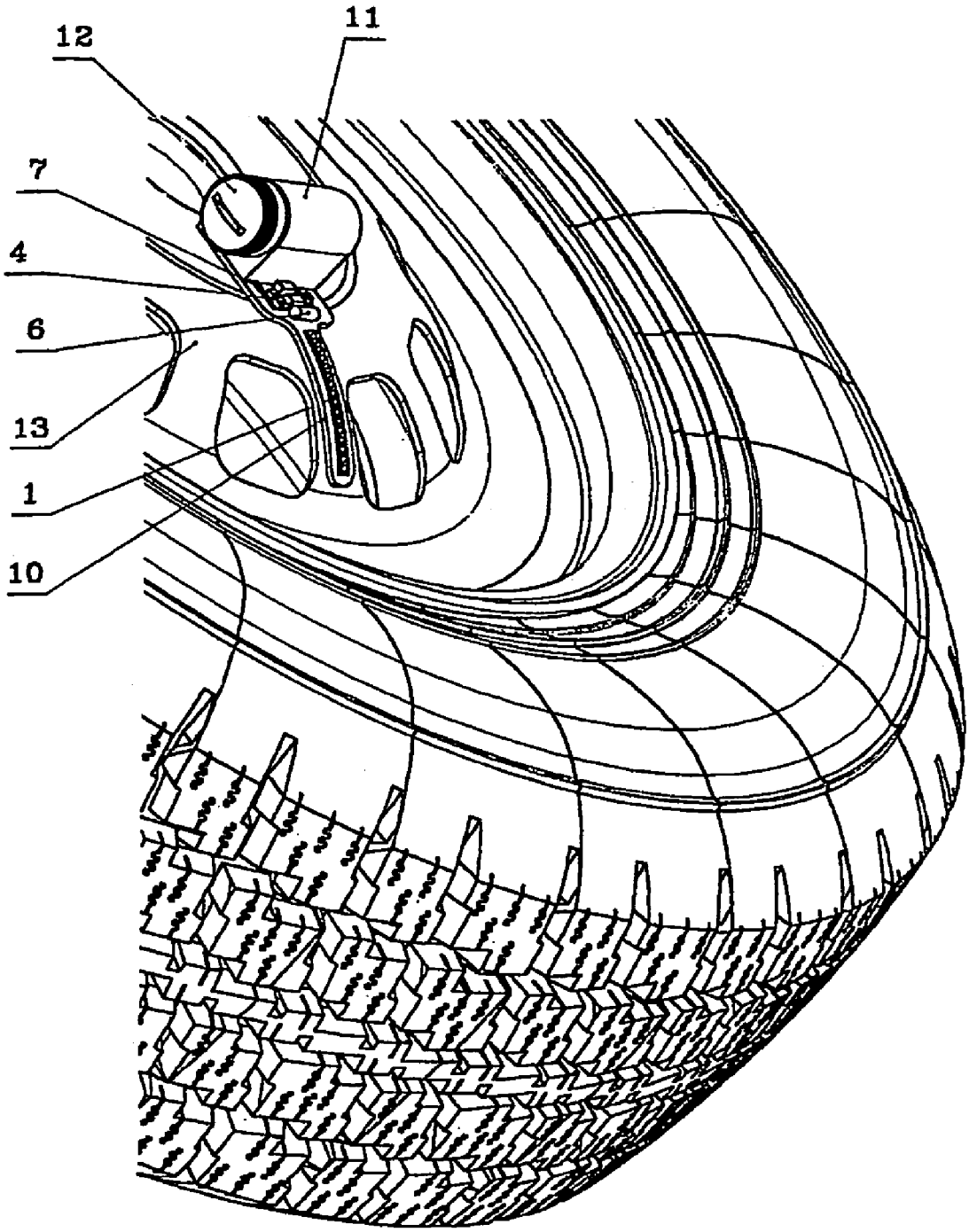
FIG. 9 is an axonometric view of the device, mounted on a rotating surface—the outer surface of a wheel rim 13.
Figure 10:
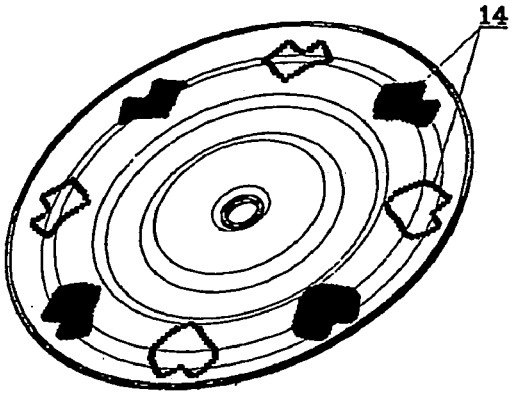
FIG. 10 to FIG. 13 are sample representations of quasimetric images, generated by the device.
Figure 11:
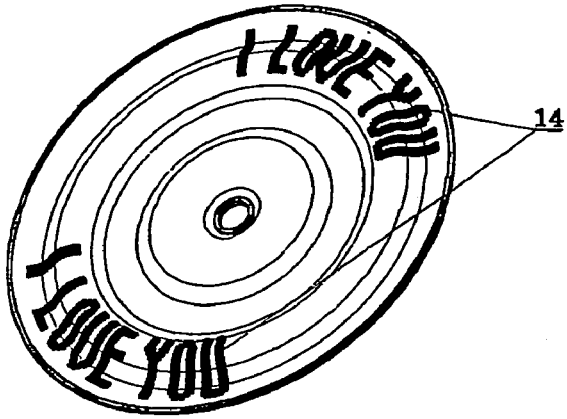
Figure 12:
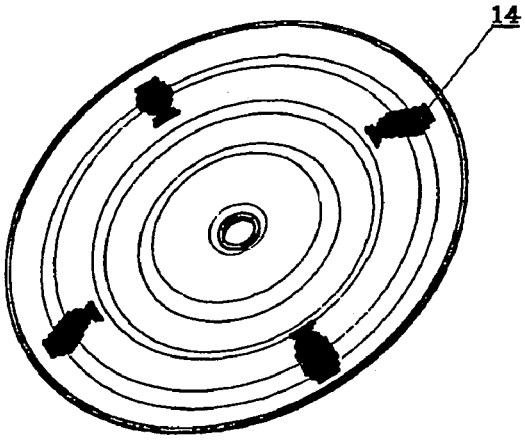
Figure 13:
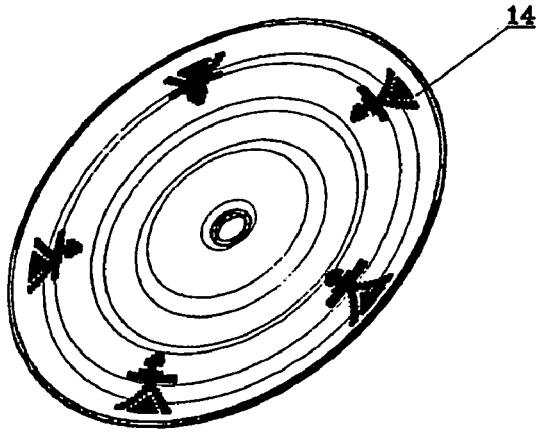

The device may be mounted on a wheel rim 13 (FIG. 9).

The quasimatrix images 14 on FIGS. 10 through 13 are generated by the device during the rotation of the object on which the device is disposed.

Figure 14:
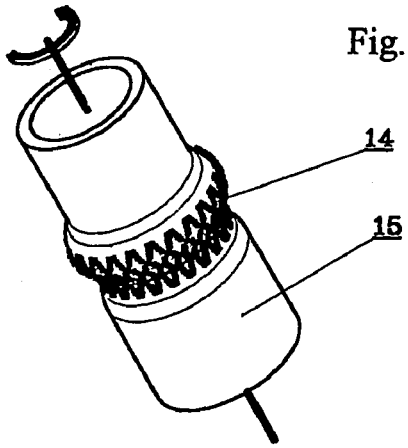
FIG. 14 is an axonometric view of the device, mounted on a rotating surface—the outer surface of a cylinder 14.

The device may be mounted on the outer surface of a rotating object 15 (FIG. 14).

Application of the Invention

The microcontroller 4 contains a library with a plurality of different visual patterns, like images, texts, light effects, or combinations of the three, recorded on its memory prior to the microcontroller's production. The interface 9, by means of the light sensor 7 acting also as an input device for the input of new data for new images, and an external source (not displayed on the drawings) allow to add additional libraries with patterns in the memory of the microcontroller 4 while using the device. The external source may be a personal computer, a laptop, a notebook, or a specialized device, provided with software and supporting the device's communication protocol, as well as input and processing of data. This allows you to repeatedly reprogram the device on the spot, according to the operator's preferences, on-line, etc.

The device is fixedly disposed on the rotating part of an object, for example, on a wheel rim 13, by means of a sticky foil 10. It is recommended that it is radially disposed relative to the rotation axis. The battery is placed in a housing case 11, after which the removable top cover 12 is hermetically sealed, for example by screwing, to secure the preservation of the battery. When the battery runs out of power, its replacement is performed in a reverse order.

The device is set in operation right after the battery is placed in it, and the microcontroller 4 starts working in a low power standby mode, so as to extend the battery life. When the motion sensor 6 receives a signal, the microcontroller 4 "wakes up" and checks the light sensor 7. In bright daylight the microcontroller 4 switches to a low power consumption mode in order to save energy. During hours of darkness, that is, in nighttime conditions, the microcontroller 4 activates its inbuilt timer for a preset time, and, meanwhile, sends signals to the light emitting diodes 1.

The transmission of signals from the microcontroller 4 to the LEDs 1 while the timer is operable, is controlled by the motion sensor 6. At each revolution of the vehicle's wheel rim 13 or of the object 15, this sensor sends a short impulse to the microcontroller 4. The microcontroller 4 records the time until the next activation of the sensor, and, in order to produce a visual pattern from the quasi rows and quasi columns of the quasi matrix, flashes on the LEDs 1 in the appropriate succession and for the required duration. This is performed at an angular speed, so as to enable the remote viewer to adequately perceive the information from the quasimatrix field 14, in the form in which it is presented by the stroboscopic effect of the transmission. Attractive light effects can be achieved through combinations of RGB type LED groups, which by their nature are creating polycolour pictures and LED groups of higher brightness forming outline frames, inserted symbols, etc. Thus, the effect "picture into the picture" is obtained. The eye of the observer is capable of perceiving the resulted visual effect due to the transitional vision of human being, which is widely used in other technical fields, such as cinematography, television, stroboscopy, etc. The data of the image generated by the quasimatrix field 14 is stored in the microcontroller 4. There are two ways in which this data can be recorded on the microcontroller's memory which are as follows:

First way: The data is prerecorded in the microcontroller's memory and cannot be modified at a later stage.

Second way: The microcontroller 4 uses a serial interface 9 in order to obtain data from an external source (not shown on the drawings) as well as the light sensor 7 acting again as an input device for the input of data for new images. The microcontroller 4 saves this data in its nonvolatile memory and then retrieves it in the manner described above. The external source may be a personal computer, a laptop, a notebook, or a specialized device, provided with the necessary software, supporting the communication protocol of the device and the input and processing of data. This allows to repeatedly reprogram the device, inclusively "on the spot" and according to your preferences.

The microcontroller's timer 4 resets its value every time it receives a signal from the motion sensor 6 when the light sensor 7 detects an absence of light, and thus provides enough operational time for the device, so that if the vehicle is accidentally lit (by the headlights of another transportation vehicle, billboards, streetlights, etc), or if the motion sensor 6 is not emitting signals (when the vehicle has stopped on a crossroad, for example), the LEDs 1 remain active for a short while. In this way the effect is visible when the vehicle passes through lit areas. Moreover, this feature of the device makes stopped vehicles more visible, because an observer will be able to see a single array of light, which may blink to warn other drivers of the vehicle's presence. Therefore, this feature provides traffic safety during darkened hours. Another function of the device, related to the use of the timer, is that it allows you to monitor the battery level when the vehicle has stopped. If the LEDs continue emitting light after the vehicle has stopped, the battery has not lost its power.

During a long stay or in bright environments, the timer will not reset. Therefore, the microcontroller 4 will send a signal for termination of the LEDs' power supply, and will switch to a low power standby mode until the device is next activated.

The invention claimed is:

1. A device for visualization of information on a rotating visible surface comprising light sources including a plurality of light emitting diodes, evenly disposed in an array on a substrate and connected by means of a driver to a microcontroller having an independent power supply and mounted on the substrate, and a synchronization sensor connected to the microcontroller, the LEDs being of one or various colors, wherein the LEDs (1) are RGB, the substrate (2) is flexible, and the synchronization sensor (6) responds to gravity when mounted on a rotating surface, whose rotation axis is not perpendicular to the Earth's surface or if the rotation axis is perpendicular to the Earth's surface, the synchronization sensor is actuated at a position relative to a given immovable point, and wherein a light sensor (7) is connected to the microcontroller (4), which in turn is connected to a control panel (8), the two sensors (6 and 7) and the controlling panel (8) are disposed on the substrate (2) and the microcontroller (4) has a serial interface (9).

2. A device for visualization of information on a rotating visible surface according to claim 1 wherein the substrate may accommodate additional P parallel groups of LEDs, containing the same or different numbers of LEDs, which have the same or different colors, or are RGB, wherein these groups of LEDs are arranged in one of an array, a checkered pattern, or in any other preset pattern in the same plane or at various distances from the substrate (2).

3. A device for visualization of information on a rotating visible surface according to claim 1 wherein the substrate (2) is hard and has a preset profile.

4. A device for visualization of information on a rotating visible surface according to claim 1 wherein the bottom of the substrate is covered with a sticky foil (10).

5. A device for visualization of information on a rotating surface comprising:

a plurality of light sources disposed in an array on a substrate;

a light sensor mounted on the substrate;

a synchronization sensor mounted on the substrate and adapted to respond to gravity when mounted on a rotating surface whose rotation axis is not perpendicular to the Earth's surface and adapted to actuate at a position relative to a given immovable point if the rotation axis is perpendicular to the Earth's surface;

a microcontroller mounted on the substrate, wherein the microcontroller is operatively coupled to the plurality of light sources and the synchronization sensor.

6. The device of claim 5, wherein the microcontroller comprises a programmable microcontroller adapted to receive data via an interface and to store the data in a memory, wherein the data comprises data relating to visual patterns displayed by the plurality of light sources.

7. The device of claim 5, wherein the microcontroller comprises an independent power supply.

8. The device of claim 7, wherein the microcontroller is adapted to alter power consumption from the power supply in response to a signal from the light sensor, and to provide signals to the plurality of light sources in response to the light sensor.

9. The device of claim 8, wherein the plurality of light emitting diodes comprise one or more colors.

10. The device of claim 8, wherein the plurality of light emitting diodes comprise RGB colors.

11. The device of claim 5, wherein the microcontroller is adapted to activate a timer and to provide signals to activate the plurality of light sources in response to the timer.

12. The device of claim 5, wherein the synchronization sensor is adapted to control signals transmitted between the microcontroller and the light sensor.

13. The device of claim 5, wherein the plurality of light sources comprises a plurality of light emitting diodes evenly disposed on the substrate.

14. The device of claim 5, wherein the plurality of light sources are operatively coupled to the microcontroller via a driver.

15. The device of claim 5, wherein the substrate comprises a flexible substrate.

16. A device of claim 5, wherein the substrate comprises a hard substrate and a preset profile.

17. The device of claim 5, further comprising a control panel disposed on the substrate and operatively coupled to the microcontroller, the light sensor and the synchronization sensor.

18. The device of claim 5, wherein the microcontroller comprises a serial interface.

19. The device of claim 5, wherein the substrate may accommodate additional P parallel groups of LEDs, containing the same or different numbers of LEDs, wherein the groups of LEDs are arranged in a preset pattern in the same plane or at various distances from the substrate.

20. The device of claim 5, wherein the bottom of the substrate is covered with a sticky foil.

* * * * *